US006527889B1

(12) United States Patent
Paschal et al.

(10) Patent No.: US 6,527,889 B1
(45) Date of Patent: Mar. 4, 2003

(54) METHOD FOR MAKING STABILIZED ARTIFICIAL TURF

(75) Inventors: Brent Paschal, McClinten-Chism, TX (US); Jack Ford, Glenrose, TX (US)

(73) Assignee: Safeplay International, Inc., Rockwall, TX (US)

( * ) Notice: Subject to any disclaimer, the term of this patent is extended or adjusted under 35 U.S.C. 154(b) by 322 days.

(21) Appl. No.: 09/643,694

(22) Filed: Aug. 22, 2000

(51) Int. Cl.[7] ..... A41G 1/00; B32B 31/00

(52) U.S. Cl. ..... 156/72; 156/279; 428/15; 428/96

(58) Field of Search ..... 156/72, 279; 264/112, 264/113; 428/85, 96, 87, 15

(56) References Cited

U.S. PATENT DOCUMENTS

| | | | | |
|---|---|---|---|---|
| 3,944,452 | A | 3/1976 | Toland | 156/72 |
| 3,995,079 | A | 11/1976 | Haas | 428/17 |
| 4,044,179 | A | 8/1977 | Haas | 428/17 |
| 4,268,551 | A | 5/1981 | Moore | 428/17 |
| 4,336,286 | A | 6/1982 | Tomarin | 428/17 |
| 4,337,283 | A | 6/1982 | Haas | 428/17 |
| 4,389,435 | A | 6/1983 | Haas | 428/17 |
| 4,396,653 | A | 8/1983 | Tomarin | 428/17 |
| 4,497,853 | A | 2/1985 | Tomarin | 428/17 |
| 4,705,706 | A | 11/1987 | Avery | 428/17 |
| 4,735,825 | A | 4/1988 | Friedrick | 437/202 |
| 5,041,320 | A | 8/1991 | Meredith | 428/87 |
| 5,352,158 | A | 10/1994 | Brodeur | 472/92 |
| 5,601,886 | A | 2/1997 | Ishikawa | 428/17 |
| 5,605,721 | A | 2/1997 | DiGeronimo | 427/373 |
| 5,678,951 | A | 10/1997 | Levasseur | 404/17 |
| 5,830,080 | A | 11/1998 | Reynolds | 473/278 |
| 5,850,708 | A | 12/1998 | Bergevin | 47/1.01 |
| 5,958,527 | A | 9/1999 | Prevost | 428/17 |
| 5,976,645 | A | 11/1999 | Daluise | 428/17 |

FOREIGN PATENT DOCUMENTS

| | | |
|---|---|---|
| CA | WO 98/56993 | 6/1997 |

*Primary Examiner*—Sam Chuan Yao
(74) *Attorney, Agent, or Firm*—Rudolf O. Siegesmund

(57) ABSTRACT

An artificial turf field comprises a mat with artificial grass stitched to the mat and rubber granules combined with powdered latex or other suitable powdered binding agent activated by water. Mats with the artificial grass affixed are laid on an athletic field. Rubber granules mixed with a bonding agent and the coated rubber granules are poured over the mats and raked until a depth of ½ to ¾ inches is achieved. Water is then misted onto the surface activating the bonding agent. The first layer is allowed to set. The first level of infil material will be bound particle to particle, to the grass and to the mat by the agent, thus ensuring a stablized shock absorbency pad. Additionally, the stabilized layer eliminates substantial migration of loose infil material. Next, uncoated rubber granules are applied to the field and raked in until only the top of the grass shows providing a finished appearance, the feel of a playing surface that is uniform, and a surface that is prevented from becoming thicker and harder in various places due to migration. The artificial grass fibers are brushed to fibrillate the ends of the artificial grass fibers.

6 Claims, 3 Drawing Sheets

METHOD FOR MAKING STABILIZED ARTIFICIAL TURF

FIELD OF THE INVENTION

The present invention relates to the creation of artificial turf playing surface.

BACKGROUND OF THE INVENTION

Artificial playing fields have gained almost universal preference over natural dirt and grass playing fields because of the reliability and ease of maintenance. Two concerns associated with artificial playing fields are player safety and uniformity of the playing surface. The artificial surface needs to allow natural movement of a player's feet when in contact with the surface to prevent sprains, tearing of tendons and muscles, and to prevent broken bones. Moreover, the artificial surface needs to prevent burns to exposed skin of the players caused by players sliding along the artificial surface. In addition, the field must have resilience to absorb some of the shock of player contact. Uniformity of the playing surface is important so that the field does not develop areas that are less resilient than others or areas where the depth of the playing surface varies from one location to another. Lack of uniformity affects both safety and performance as the soccer, football or rugby ball in use will bounce or roll differently depending on the field characteristics. Finally, it is desirable to construct an artificial field in which drainage can be achieved without a raised crown in the center of the field. The raised crown makes ball handling different from a flat natural surface because a player kicking or throwing a ball from the center of the field will be higher than a receiving player near the outer edge of the field.

Artificial turf is presently made of polyurethane mats with artificial grass made of polyethylene or nylon stitched to the mats which are then laid on a field. One method of improving appearance, performance and safety is to fill in the spaces between the artificial grass with an infil material to make the blades stand up straight. As used herein, infil material means particles that can be poured and raked into and between blades, shafts or fibers of artificial grass. The most common infil materials are sand and resilient particles such as rubber granules. The infil material is poured over the mats and raked into the artificial grass until only the top ends of the grass are showing. Problems arise because the various infil materials, individually or in mixtures, will migrate horizontally and vertically. Horizontal migration occurs when player movement kicks up infil material. Additionally, rain will cause infil material to rise and move with the flow of water over the field, particularly with fields designed with a center crown. Vertical migration occurs when small or fine particles move downward within the infil material and the larger particles move to the top. Vertical migration is caused by vibration or player movement and contact. Vertical migration is also caused by rain water draining down through the infil material and causing the infil material to float and move with the movement of the water. A method, known as the thatch system, combats migration by tufting every other stitch with textured nylon in an attempt to limit movement of the infil material.

The prior art discloses numerous attempts to improve the safety and performance of infil material and to minimize or eliminate vertical and horizontal migration of the infil material. U.S. Pat. No. 5,580,708 discloses a fibrillated fiber. FIG. 1 depicts a representative synthetic grass fiber 36 which is fibrillated. Fibrillated as used in the '708 patent means that synthetic grass fibers 36 have several blade openings 40 through each synthetic grass fiber 36. Blade openings 40 result in connected strands 38 within synthetic grass fiber 36. U.S. Pat. No. 4,337,283 discloses a mixture of sand and rubber particles in order to achieve resiliency of the field playing surface. U.S. Pat. No. 5,976,645 (the '645 patent) discloses a system comprising a pile fabric over a porous aggregate layer. The pile elements are tufted to a backing and an infil layer is introduced consisting essentially of resilient particles. The '645 patent discloses infil particles which can be natural rubber, synthetic rubber such as styrene butadine (ground tire rubber), butyl rubber, neoprene, urethane rubber and nitrile rubber. U.S. Pat. No. 5,958,527 (the '527 patent) discloses a pure sand base, a pure rubber top course, and a middle course of mixed sand and rubber. The '527 patent also discloses fibrillated top ends of the artificial grass to retain the relatively large top rubber particles in a loose netlike flexible structure. The loose criss-cross net of fibrillated fibers also allows dislodged rubber particles to work back into the underlying top rubber course.

U.S. Pat. No. 4,396,653 discloses fibrillated fibers, rubber particles and a binder material that may be added to the rubber like particles. FIG. 2 depicts the prior art configuration of the '563 patent. Artificial turf 10 has fibers 14 woven into base sheet 20 with warp type strand 16 and woof type strand 18. Fibers 14 are fibrillated to produce separate fiber ends 12. The binders disclosed are commercially available rubber adhesives or cements which are sprayed or spilled upon infil particles in lower layer 24 so as to trickle down between and connect adjacent particle surfaces that are contacted by the adhesive or cement. The binder does not fill the spaces between the particles, but serves to tack adjacent portions of particle surfaces to one another forming a porous material in which at least some, but not necessarily all, of the particles are spot fastened together. FIG. 2 depicts a representation of binder 34 tacking portions 36 of particles 32 to binder 34.

U.S. Pat. No. 4,735,825 (the '825 patent) discloses a bonding agent which can either be permanent or temporary. The '825 patent discloses mixing the bonding agent with the free flowing bulk material prior to the material being distributed in the pile of the artificial grass and activating the bonding agent at a later time. The '825 patent discloses a heat treatment for activating the bonding agent. The '825 patent discloses such water insoluble agents as PVC powder, PET powder, melting fibers, aqueous synthetic resin dispersing, or synthetic resin dispersing in solvent for bonding agents. In the '825 patent, drainage of the bonded infil material is achieved by mixing a water soluble element with the rubber granules and the bonding agent so that when water is added the water soluble element will wash out leaving spaces for drainage.

What is needed beyond the prior art is a way to bond rubber particles by physical adhesion so that drainage will take place in the spaces between the granules and also to achieve uniform results in adhesion. Additionally, what is needed is a way to bond a layer of rubber granules near the mat to prevent vertical and horizontal migration so that there will always be a minimum layer of rubber to absorb impact while allowing a loose upper layer of granules to improve field performance. Finally, what is needed beyond the prior art is a way to prevent horizontal migration of the upper layer of loose rubber granules. The goal therefore, is to achieve an infil system that will not migrate or displace over a long period of time.

SUMMARY OF THE INVENTION

The invention meeting the needs identified above is an artificial turf field comprising a mat with artificial grass stitched to the mat and rubber granules combined with powdered latex or other suitable powdered binding agent activated by water. Mats with the artificial grass affixed are laid on an athletic field. Rubber granules mixed with a bonding agent and the coated rubber granules are poured over the mats and raked until a depth of ½ to ¾ inches is achieved. Water is then misted onto the surface activating the bonding agent. The first layer is allowed to set. The first level of infil material will be bound particle to particle, to the grass and to the mat by the agent, thus ensuring a stablized shock absorbency pad. Additionally, the stabilized layer eliminates substantial migration of loose infil material. Next, uncoated rubber granules are applied to the field and raked in until only the top of the grass shows providing a finished appearance, the feel of a playing surface that is uniform, and a surface that is prevented from becoming thicker and harder in various places due to migration. The artificial grass fibers are brushed to fibrillate the ends of the artificial grass fibers.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
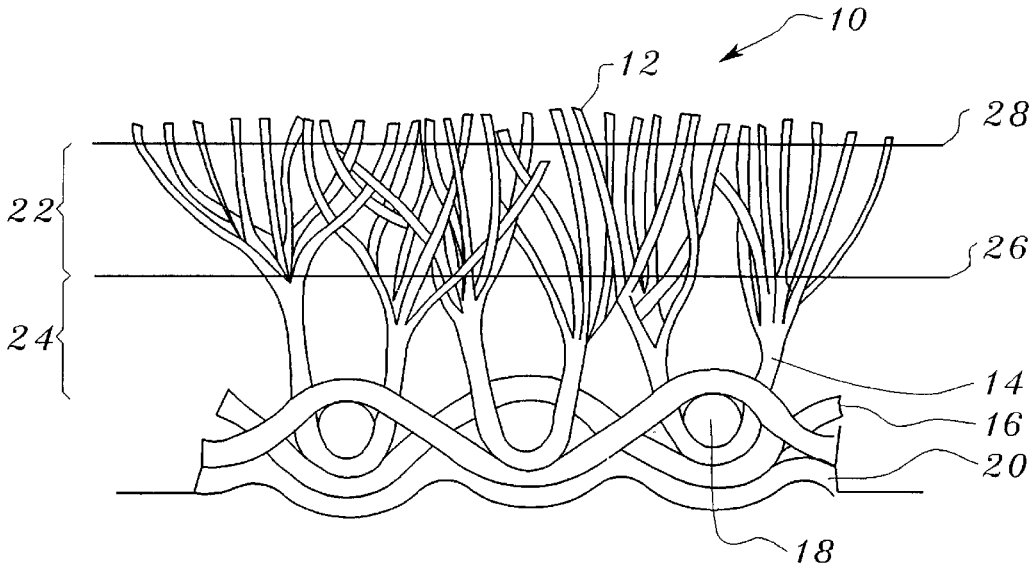
( PRIOR ART ) Fig. 1
FIG. 1 depicts a prior art fibrillated fiber.
Figure 2:
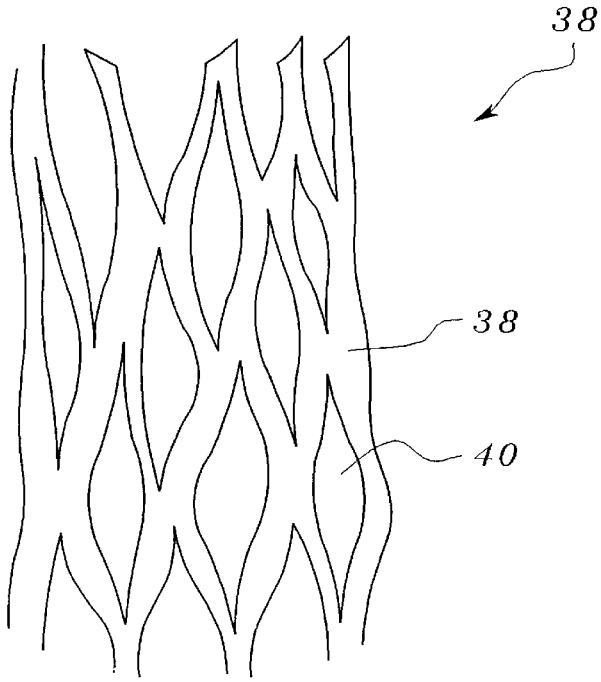
( PRIOR ART ) Fig. 2
FIG. 2 depicts a prior art artificial grass configuration with fibrillated fibers, a mat and two infil layers.
Figure 3:
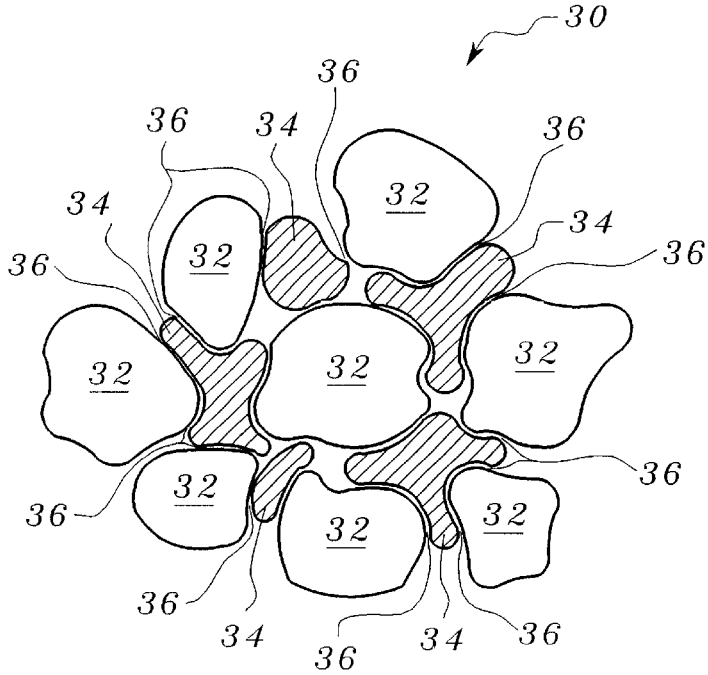
( PRIOR ART ) Fig. 3
FIG. 3 depicts a prior art binder configuration.
Figure 4:
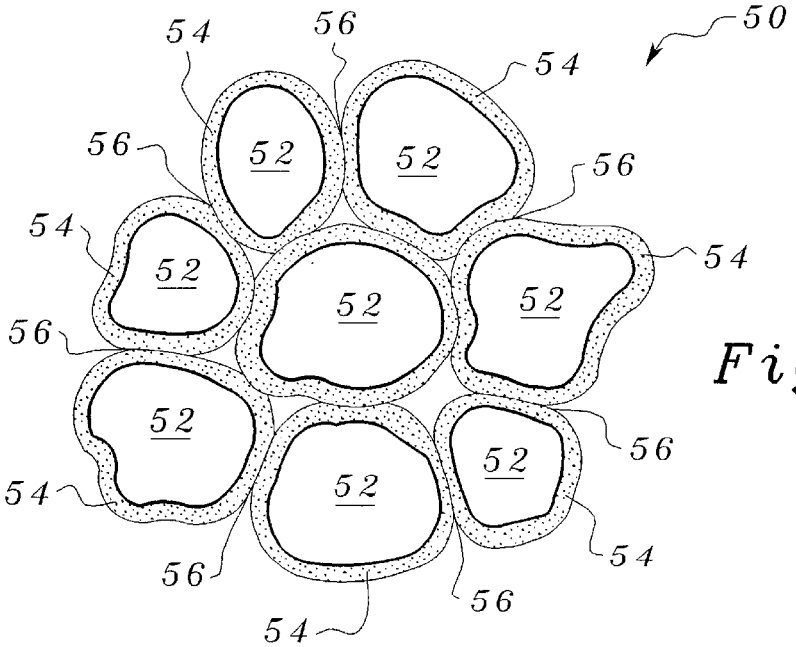
FIG. 4 depicts the coated particle binder configuration.

FIG. 4 depicts coated particles 50 with bonding agent 54 affixed to infil particles 52. Infil particles 52 have been mixed with and coated with bonding agent 54 to create coated particles 50. In the preferred embodiment, infil particles 52 are SBR Rubber Granules with diameters between 0.5 and 1.5 mm. When activated, bonding agent 54 adheres along contact areas 56.

Figure 5:
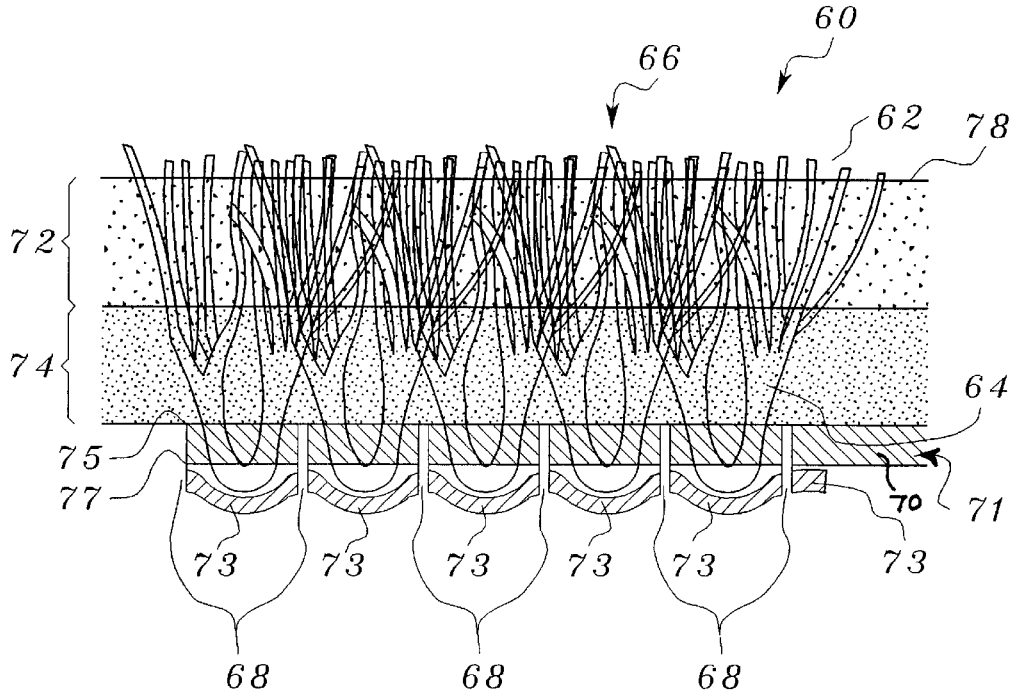
FIG. 5 depicts the coated binder in a two layer infil system with fibrillated fibers.

FIG. 5 depicts first turf 60 with first mass 66 of first fibers 62. First fibers 62 are made of polyethylene and are initially approximately 15/32 inch wide. First fibers 62, when brushed, will fibrillate longitudinally. As used herein, fibrillation means an act or process of forming fibers or fibrils (a small filament or fiber) where, when the ends of the fiber are brushed, the fibers will continue to separate into finer and finer fibrils upon each subsequent brushing. First Fibers 62 have the characteristic, when brushed, of separating into thinner and thinner strands. For example, when first brushed, first fibers 62 may separate into 4 strands. On the next brushing contact, first fibers 62 may separate into 8 strands. When brushed again, first fibers 62 may separate into 16 or 32 strands and so on. One commercially available type of polyethylene fiber are 10,000 denier synthetic fibers manufactured by Polyloom Corporation under the trade name Z-Pro. Stems 64 are unfibrillated portions of first fibers 62. First fibers 62 are stitched to mat 71 and are capable of achieving more fiber per square yard with less actual weight of fiber. For example, other fibers commonly in use for artificial turf use 42 ounces of fiber per square yard. First fibers 62 can achieve the same or greater amount of fiber while using only 42–45 ounces of fiber per square yard due to the effect of fibrillation and the ability of first fibers 62 to continue to fibrillate upon repeated brushing. After being stitched to the mat, first fibers 62 are trimmed to a length of approximately 2 and ⅞ inches. First fibers 62 have stems 64 that are stitched in rows and stems 64 are closer together in the rows than other types of artificial turf. Specifically, first fibers 62 are stitched with five stitches per running inch in a row, while other artificial turf mats are prepared with only three stitches per running inch in a row. In addition, first fibers 62 are stitched in rows that are further apart than stitched rows in other turf mats. The space between stitched rows in mat 71 is approximately three quarters of an inch. Mat 71 is pierced with holes 68 so that water may drain through mat 71. Mat 71 has primary backing 70 of polyethylene with approximately 7.623 ounces per square yard and secondary backing 73 of polyurethane with approximately 64.62 ounces per square yard. First fibers 62 are stitched to primary backing 70 and then secondary backing 73 is applied to underside 77 of primary backing 70. In the preferred embodiment, mats 71 are made in 15 foot widths.

Infil particles 52 are shown in loose mass 72 and bonded mass 74. In the preferred embodiment, infil particles 52 are rubber granules as described above. Coated particles 50 are raked until a depth of ½ to ¾ inches is achieved. In the preferred embodiment, butyl and water are mixed in a mister in a proportion of approximately 1 part butyl to 16 parts water. One ounce of butyl is mixed with sixteen ounces of water in a mister. The water and butyl mixture is then misted over the surface of coated particles 50 activating bonding agent 54 (See FIG. 4). Butyl is introduced into the mixture to cause the water to evaporate faster, thereby causing the field to cure more quickly. Therefore, only water is necessary to the bonding process. A mist must be utilized in order to achieve saturation. As used herein, the term misting means to create water in the form of particles floating or falling in the atmosphere at or near the surface of the earth and approaching the form of rain. The misting continues until saturation of coated particles 50 is achieved. In the preferred embodiment, bonding agent 54 is powdered latex and chalk. Chalk is added to the powdered latex so that once the powdered latex is activated, causing the rubber granules to bind together, the powdered latex will not reactivate or separate when rain falls on the artificial turf field. In the preferred embodiment, approximately 10 pounds Vinnex LL3350, approximately 1 pound chalk and approximately 50 pounds rubber granules are mixed to prepare coated particles 50. The proportions of the mixture can be varied depending on the geographical region in which the artificial turf field is to be installed. Annual rainfall, ambient temperature and expected moisture content of the field are considered when selecting the proportions of the mixture. The preferred embodiment mixture is designed for most common playing field installation situations. In an alternate embodiment, approximately one pound Vinnex LL3350, approximately two pounds of chalk and approximately 100 pounds of rubber granules are mixed to prepare the coated rubber granules which are the coated particles 50 of FIG. 4. In another embodiment, approximately ½ pounds of VINNEX LL 3350 and approximately 1½ pounds of chalk are mixed with approximately 100 pounds of rubber granules. VINNEX LL 3350 is a self crosslinking solid binding polymer based on polyvinyl acetate with reactive groups. Only physical bonding is achieved. No chemical bonding takes place. Upon activation, coated particles 50 physically adhere together and create bonded mass 74.

Referring to FIG. 4, the moisture brought to coated particles 50 by misting activates bonding agent 54 of coated particles 50 and coated particles bond together at contact areas 56. When coated particles 50 adhere to each other along contact areas 56, the spaces between coated particles 50 where there is no contact remain free and open. Therefore, referring to FIG. 5, bonded mass 74 is porous and, once set, water will drain down through bonded mass 74 by seeping through the spaces between coated particles 50 where coated particles 50 are not in contact with each other. Bonded mass 74 is allowed to set. Once set, bonded mass 74 will not reactivate or separate when rains falls on bonded mass 74. Bonded mass 74 is resilient in a range from minus 60 degrees Fahrenheit to plus 160 degrees Fahrenheit. Bonded mass 74 will be bound particle to particle and also to the artificial grass and to the mat, therefore eliminating substantial migration of rubber or any other type of flexible granules. The misting of coated particles 50 ensures a uniformity of both adhesion and porosity because each infil particle 52 is coated and each coated particle 50 may be activated if full saturation is achieved. Bonded mass 74 extends from top surface 75 of primary backing 70 of mat 71 to a height of approximately ½ to ¾ inches above top surface 75. Bonded mass 74 ensures that the field will always have a minimum amount of resilient material so that a player, falling on the field, will have a minimum amount of shock absorbency. Other artificial turf fields cannot guarantee a consistent G Max rating due to horizontal and vertical migration of the particles used. However, bonded mass 74, by providing a stabilized lower layer, can guarantee a G Max rating that will not exceed 200. By G Max is meant a rating system for shock absorbency in which a projectile is dropped onto the surface to be tested, and the accelerations of the projectile at impact and upon recoil from the surface are compared under ASTM 355. A desirable G Max rating for an artificial turf field is between 50 and 200 and bonded mass 74 provides for a consistent low G Max rating at all times. Optionally, bonded mass 74 may be strengthened by applying a layer of VINNEX LL 3350 over bonded mass 74 after it has set, and then misting over the new applied layer of VINNEX LL 3350 so that a top coat is applied to bonded mass 74.

Loose mass 72 of infil particles 52 is applied on top of bonded mass 74 so that the tops of fibers 62 extend above loose mass 72. Because of bonded mass 74, even if loose mass 72 migrates in various parts of the field, the field itself should never have a G Max rating greater than 200 because of the stabilized lower layer of bonded rubber granules in bonded mass 74. Loose mass 72 is applied until approximately ½ inch of first fibers 62 remain above loose mass 72. First fibers 62 are then brushed until the exposed ends of first fiber 62 fibrillate into multiple separate strands of fiber. The fibrillated ends of first fiber 62 will inhibit horizontal and vertical migration of infil particles 52.

Figure 6:
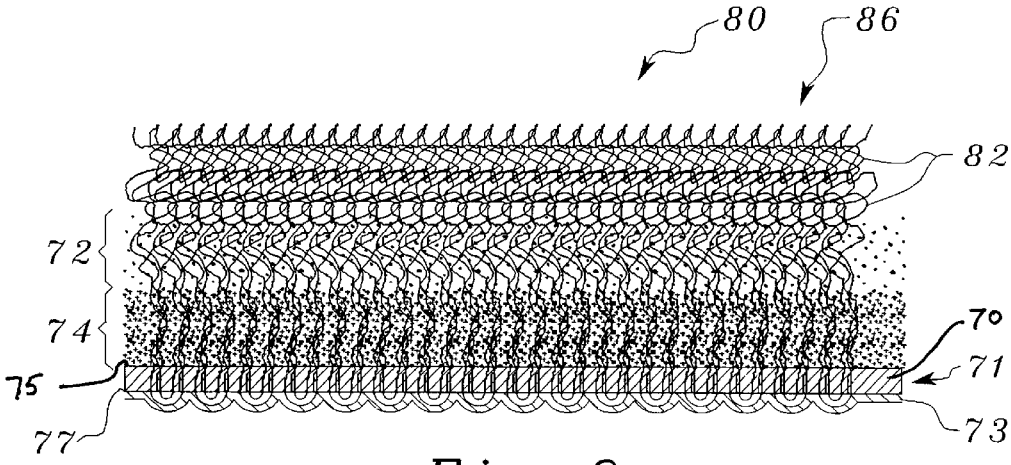
FIG. 6 depicts the coated binder in a two layer infil system with twisted and crimped fibers.

FIG. 6 depicts second turf 80 having second mass 86 of second fibers 82. Second fibers 82 are crimped and twisted. The twisting and crimping characteristics of second fibers 82 allow less rubber granules to be used than with first turf 60 and further disallows the migration of rubber particles. Second fibers 82 are polyethylene fibers. Mat 71 has second fibers 82 affixed to second mat 71 by stitching. Mat 71 is pierced with holes (not shown) so that water may drain through mat 71. Second fibers 82 are stitched to primary backing 70 and then secondary backing 73 is applied to underside 77 of primary backing 70.

The method of creating first turf 60 and second turf 80 involves the following steps: laying, mixing, pouring, raking, misting, setting, pouring and brushing. In the laying step, mats with artificial turf are placed on a prepared surface. In the mixing step chalk and powdered latex are mixed with rubber granules until the rubber granules are coated. Next, the coated particles are poured onto the mats. The coated particles are raked until a depth of approximately ½ to ¾ inches is achieved. Next, the field is misted with water or a mixture of water and butyl until saturation is achieved. The coated particles that have been activated by the moisture are allowed to set into a bonded mass. Next, uncoated particles are poured over the bonded mass and raked until approximately ½ inch of fibers remains above the loose mass. The approximate average length of exposed fibers above the loose mass can be varied by adding or taking away rubber granules. The approximate average length of exposed fibers above the loose mass of rubber granules is selected based upon the requirements of the sport or sports to be played on the field. The final step of brushing entails brushing the exposed ends of the fibers until they fibrillate into multiple separate strands.

The advantages provided by the present invention should be apparent in light of the detailed description provided above. The description of the present invention has been presented for purposes of illustration and description, but is not limited to be exhaustive or limited to the invention in the form disclosed. Many modifications and variations will be apparent to those of ordinary skill in the art. The embodiment was chosen and described in order to best explain the principles of the invention the practical application and to enable others of ordinary skill in the art to understand the invention for various embodiments with various modifications as are suited to the particular use contemplated.

What is claimed:

1. A method of making an artificial playing field comprising:

mixing a bonding agent and rubber granules to create an infil mixture of coated rubber granules;

applying coated rubber granules to turf consisting of polyethelene fibers;

mixing butyl with water in a mister;

applying the water and butyl mixture to the infil mixture with the mister until saturated;

setting the infil mixture;

adding uncoated rubber granules; and brushing the artificial turf.

2. The method of claim 1 wherein the bonding agent is powdered latex and chalk.

3. The method of claim 1 wherein the proportions of the bonding agent to rubber granules is approximately 3 pounds of bonding agent to 100 pounds of rubber granules.

4. The method of claim 1 wherein the proportion of butyl to water is approximately 1:16.

5. The method of claim 1 further comprising the step of laying mats on a prepared surface.

6. The method of claim 1 further comprising the step of raking said coated rubber granules to a depth of between approximately ½ inch and ¾ inch.

* * * * *